United States Patent [19]

Honekman et al.

[11] Patent Number: 4,567,461

[45] Date of Patent: Jan. 28, 1986

[54] ELECTRONIC DART GAME SCOREBOARD

[75] Inventors: Robert D. Honekman, 5014 Blackhorse Rd., Palos Verdes, Calif. 90274; Curt Fisher, Palos Verdes, Calif.

[73] Assignee: Robert D. Honekman, Rancho Palos Verdes, Calif.

[21] Appl. No.: 468,172

[22] Filed: Feb. 22, 1983

[51] Int. Cl.[4] ..... G08B 23/00

[52] U.S. Cl. ..... 340/323 R; 273/1 C; 273/1 ES

[58] Field of Search ..... 273/1 C, 1 ES, 317, 273/371, 381, 416; 340/323 R; 178/31

[56] References Cited

U.S. PATENT DOCUMENTS

| | | | |
|---|---|---|---|
| 2,713,490 | 6/1955 | Thompson | 340/323 X |
| 3,193,818 | 7/1965 | McDannold | 340/323 |
| 3,392,239 | 7/1968 | Johnson | 178/31 X |
| 3,836,148 | 9/1974 | Manning | 273/371 X |
| 3,959,640 | 5/1976 | Syria | 340/323 R X |
| 4,045,788 | 8/1977 | Castelli et al. | 340/323 R |
| 4,072,930 | 2/1978 | Lucero et al. | 340/323 R X |
| 4,130,871 | 12/1978 | Olsen et al. | 340/323 R X |
| 4,263,736 | 4/1981 | Beierwaltes et al. | 340/323 R X |
| 4,266,214 | 5/1981 | Peter | 340/323 R |
| 4,272,649 | 6/1981 | Pfeiffer | 271/1 E |

FOREIGN PATENT DOCUMENTS

| | | | |
|---|---|---|---|
| 1563601 | 3/1980 | United Kingdom | 273/1 ES |
| 2030877 | 4/1980 | United Kingdom | 273/1 ES |
| 2086243 | 5/1982 | United Kingdom | 273/371 |
| 2087734 | 6/1982 | United Kingdom | 273/1 ES |

*Primary Examiner*—Ulysses Weldon

*Attorney, Agent, or Firm*—Beehler, Pavitt, Siegemund, Jagger & Martella

[57] ABSTRACT

An electronic dart game scoring device includes individual game select switches for each of several games including cricket, team select switches, numerical entry keys for score entry and numerical score displays. The device is particularly adapted for scoring the game of cricket by including a number of score entry switches dedicated to particular dart board beds and visual indicators associated with the dedicated switches for displaying dart scores on each of the particular beds, separately from the numerical score displays.

7 Claims, 4 Drawing Figures

10
16
18
30
32
28g
16c"
16c'
18c
16c
18c'
18c"
28f
28e
16b"
16b'
18b'
18b
16b
28d
18b"
28c
16a"
16a'
18a
28b
16a
18a'
18a"
28c
28
12
12a
14
CRICKET
RESET
ERROR
32
30
12b
1001
T1
T2
20
ON
OFF
12c
701
24a
24b
12d
501
22
12e
401
ENTER
12f
301
26

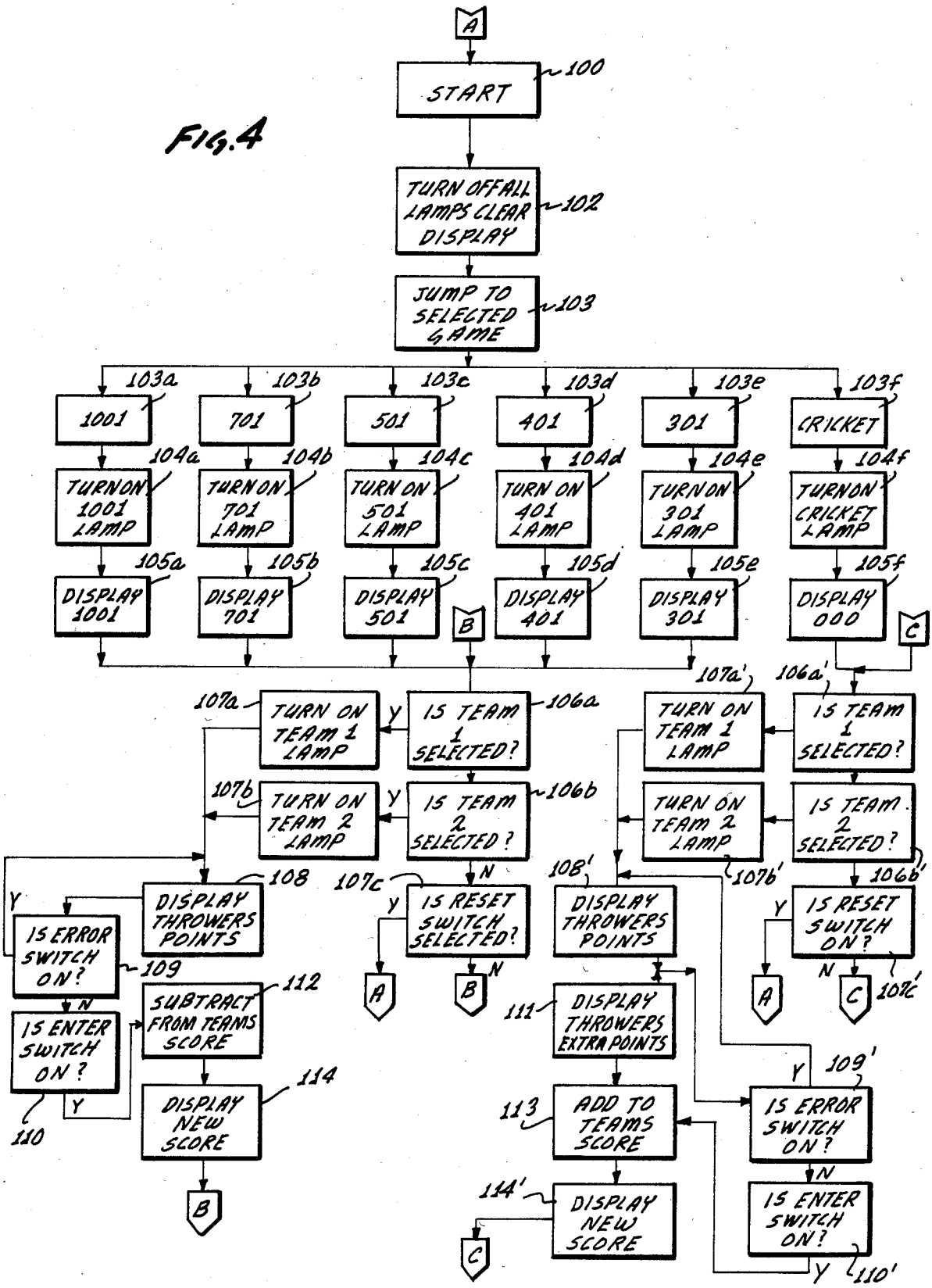
FIG. 4
A
START
100
TURN OFF ALL LAMPS CLEAR DISPLAY
102
JUMP TO SELECTED GAME
103
103a
1001
103b
701
103c
501
103d
401
103e
301
103f
CRICKET
104a
TURN ON 1001 LAMP
104b
TURN ON 701 LAMP
104c
TURN ON 501 LAMP
104d
TURN ON 401 LAMP
104e
TURN ON 301 LAMP
104f
TURN ON CRICKET LAMP
105a
DISPLAY 1001
105b
DISPLAY 701
105c
DISPLAY 501
B
105d
DISPLAY 401
105e
DISPLAY 301
105f
DISPLAY 000
C
107a
TURN ON TEAM 1 LAMP
Y
IS TEAM 1 SELECTED?
106a
107b
TURN ON TEAM 2 LAMP
Y
IS TEAM 2 SELECTED?
106b
N
107c
IS RESET SWITCH SELECTED?
Y
A
B
N
108
DISPLAY THROWERS POINTS
Y
IS ERROR SWITCH ON?
109
N
IS ENTER SWITCH ON?
110
Y
SUBTRACT FROM TEAMS SCORE
112
DISPLAY NEW SCORE
114
B
107a'
TURN ON TEAM 1 LAMP
106a'
IS TEAM 1 SELECTED?
107b'
TURN ON TEAM 2 LAMP
106b'
IS TEAM 2 SELECTED?
108'
DISPLAY THROWERS POINTS
Y
IS RESET SWITCH ON?
N
A
C
107c'
111
DISPLAY THROWERS EXTRA POINTS
113
ADD TO TEAMS SCORE
114'
DISPLAY NEW SCORE
C
Y
109'
IS ERROR SWITCH ON?
N
IS ENTER SWITCH ON?
Y
110'

ELECTRONIC DART GAME SCOREBOARD

BACKGROUND OF THE INVENTION

1. Field of the Invention

The present invention pertains generally to the field of game scoring devices and more particularly relates to an electronic dart game scorer. In a presently preferred embodiment, the electronic dart scorer includes a voice recognition system which receives a spoken dart score as the input to the scoring device in lieu of manually operated input switches, and also includes a voice synthesized game score output.

2. State of the Prior Art

The game of darts is a game of skill and competition which is played by throwing darts at a dart board divided by circles and radial lines into segments or beds numbered between one and twenty and arranged in a standard configuration. The game of darts actually includes several related games which are played by throwing darts at such a dart board. The games differ mainly in the arithmetics by which the scores obtained by successive throws of the darts are added or subtracted to achieve a winning score.

For example, in one series of popular games the game starts with a initial score which may be 301, 401, 501, 701, or 1001. Darts are thrown by each player in sets of three darts and a set score is obtained by adding the numbers of the board segments on which each of the three darts has landed. This set score is subtracted from the beginning score to obtain a first intermediate score. The opposing player then throws his first set of three darts and subtracts the resulting set score from his beginning score, which is of course the same as the first player's beginning score. Successive sets of darts are thrown by turns by the opposing players or teams according to established rules. The game ends when a player's last dart thrown and scoring is the double of the number equal to one-half of the remaining score. While many variations of the precise rules applicable to each of the games exists, the most popular dart games played at present may be divided generally into two classes. The first class is the aforementioned type of game wherein intermediate scores are substracted from a beginning score. A second class includes the game of cricket, which is somewhat more complex and also differs from the aforementioned group of games in that intermediate scores are added to obtain a cumulative end score.

The game of cricket, insofar as is relevant to this specification, requires the players to score three dart landings in each of the dart board beds numbered 15 through 20. Three landings in each of these particular beds must be scored. In addition, if one player scores more than three landings in a particular numbered bed and the opponent has not yet scored three landings in the same numbered bed, the extra landing for the one player is recorded as a cumulative numerical point score separate from the necessary three landings in that bed. Thus, a cumulative point score is kept for each of the players in addition to the scoring of three of each of the numbers between 15 and 20. The winner of the game is the player who first lands three darts in each of the beds between 15 and 20, and who has the highest point score. In the game of cricket, the beginning score is zero, and successive score points are added to keep an increasing running total of the point scores for each of the players.

Historically, dart game scores were kept by "chalking" i.e., writing in chalk on a scoreboard in numerals sufficiently large to be visible to the players and audience. Such scorekeeping suffered from two shortcomings: the legibility of the scores hinged on the quality of the handwriting of the particular scorekeeper, and was also subject to arithmetical errors since the calculations were usually carried out in the scorekeeper's mind.

As a result, various attempts have been made to construct mechanical or electrical scorekeeping devices which would standardize the size and legibility of the score numbers as well as to minimize the likelihood of arithmetical error during the scorekeeping process. Various such scorekeeping devices are known to exist, including purely mechanical devices as well as electronic devices which are based on digital electronic circuits which carry out the arithmetical operations and display the resulting scores by means of alphanumeric displays of various types including L.E.D. or L.C.D. readouts, as well as video screen displays. Some of the existing scorekeeping devices also are capable of displaying several of the latest successive intermediate scores for each of the players or teams.

While the scorekeeping devices of the prior art are adequate for keeping score of a closely related group of dart games, i.e., the first class of games referred to above which differ only in the beginning score but in which all individual throw scores are subtracted from the beginning score, no existing devices make provision for scorekeeping of games such as cricket which differ significantly from the other games.

Existing score keeping devices of the type described above suffer from a source of potential error in scorekeeping associated with the erroneous actuation of numerical data input keys or switches. Up to the present, no means has been found for removing this source of error which is particularly frequent where a game such as darts is played typically in pubs and similar establishments where the consumption of alcoholic beverages is virtually a normal part of the game. It is also desirable to provide an output device as a substitute for the illuminated numeric displays normally used in such scorekeeping devices. This is because the score output must be clearly visible and legible to players who may be 20 or more feet away from the scorekeeping device and the score display panel. To insure clear legibility normally requires the use of relatively large and therefore costly and bulky display panels. In addition, such panels must be placed at locations where other players or patrons of the establishment will not stand so as to interfere with the clear viewing of the score display by the game players.

SUMMARY OF THE INVENTION

The electronic scorekeeper of the present invention improves over the devices of the prior art by providing a more flexible, nearly foolproof electronic scorekeeping system less susceptible to error, which includes provisions for keeping scores of the cricket game as well as the other games of the 401 type. Ease of operation and likelihood of confusion on the part of the scorekeeper is kept to an absolute minimum by provision of individual game select switches for each of the several games including cricket; team or player select switches; a numerical entry keyboard for entering the scores; and at least two primary numerical displays for each team, such as seven segment L.E.D. arrays for displaying the numerical scores. A further feature provided in the improved scorekeeping device of this invention is a secondary numerical display associated with each of the primary numerical displays for showing the individual score preceding each of the intermediate game scores. An error switch is provided for clearing the latest entry in the event that an error is made in pressing the keys of the score entry keyboard. A system reset switch is also provided for clearing the scorekeeper and zeroing all displays. To further avoid confusion or a mistake each of the game select switches and team select switches may be provided with visual signals such as L.E.D.s which remain lit after the corresponding switch is depressed.

A separate series of score entry switches are dedicated for entering each of the numbers between 15 and 20 in the game of cricket. Associated with each of these dedicated switches and interconnected with the team selecting switches are two series of three visual indicators such as light emitting diodes. Each visual indicator may be an L.E.D. which is lit to indicate the landing of one dart on the particular bed. The cricket display is thus preferrably arranged in a rectangular array of six L.E.D.s horizontally by six L.E.D.s vertically, divided along the middle by a vertical row of dedicated switches. In such an array it is readily possible to understand at a glance the relative competitive position of the two players or teams. As was explained above the game of cricket additionally involves the keeping of a numerical score. This is entered by means of the separate numerical entry keyboard, thus avoiding any confusion between entry of numerical score and scoring of the individual numbers between 15 and 20 which do not form part of the numerical score.

In a preferred embodiment of the invention the problem of erroneous actuation of particular data input keys or switches on the scoring device panel is obviated by the provision of a voice recognition electronic system which is programmed to recognize a limited number of input words corresponding to the data input switches described above in connection with the more basic manually operated embodiment by the invention. The sequence of actuation of the data inputs by way of spoken words is programmed into the system such that a game selection must be made by voicing one or more recognizable game select words before a team selecting can be made by speaking recognizable team select words. Thereafter numerical score input data is accepted by the device upon recognizing a correctly worded score input number. For increased reliability a password may be required prior to voicing of the numerical data or any other voice input so as to open a window in time during which the scorekeeper device will accept data, thus preventing the device from reacting to spurious conversation which may contain numerical information which could be mistakenly accepted by the device as valid score input data.

The further problem of providing an output device which does not suffer from the shortcomings of a visual display which can be easily obstructed by other players or patrons or which may be too small to be clearly viewed from a normal playing distance is overcome in the present invention by the provision of a voice synthesizer output device which receives the numerical game score output computed by the scoring device and synthesizes speech for conveying the numerical score output information. The voice output may be delivered through an audio amplifier driving an output transducer such as a loudspeaker at a sufficient volume to be clearly heard by all players and spectators alike. Desirably, the voice synthesized output is provided in addition, to rather than as a substitute for the visual display. Thus, the voice output makes an announcement at the time that a new score is first displayed while the visual displays may include a listing of several immediately previous intermediate game scores for each of the participants or teams, as well as the individual scores for each of the last two, three or more throws for each of the players.

In yet another embodiment of the invention the synthesized voice output of the scorekeeper is transmitted via a low power radio frequency communication channel to lightweight compact radio receivers worn by each game participant and interested spectator. The audio output of the radio receivers may be connected to a set of lightweight headphones of the open air type which do not substantially interfere with a persons normal hearing of sounds in the environment, yet assure clear communication of the scorekeeper synthesized output even in very noisy environments such as a lively crowded pub.

These and other characteristics of the present invention are better understood by reviewing the following figures which are submitted for the purposes of illustration only and not limitation, wherein like elements are referenced by like numerals, in light of the detailed description of the preferred embodiment.

BRIEF DESCRIPTION OF THE DRAWINGS

FIG. 4 is a flow chart diagram of one possible algorithm for the electronic scorekeeper of this invention.

DETAILED DESCRIPTION OF THE INVENTION

Figure 1:
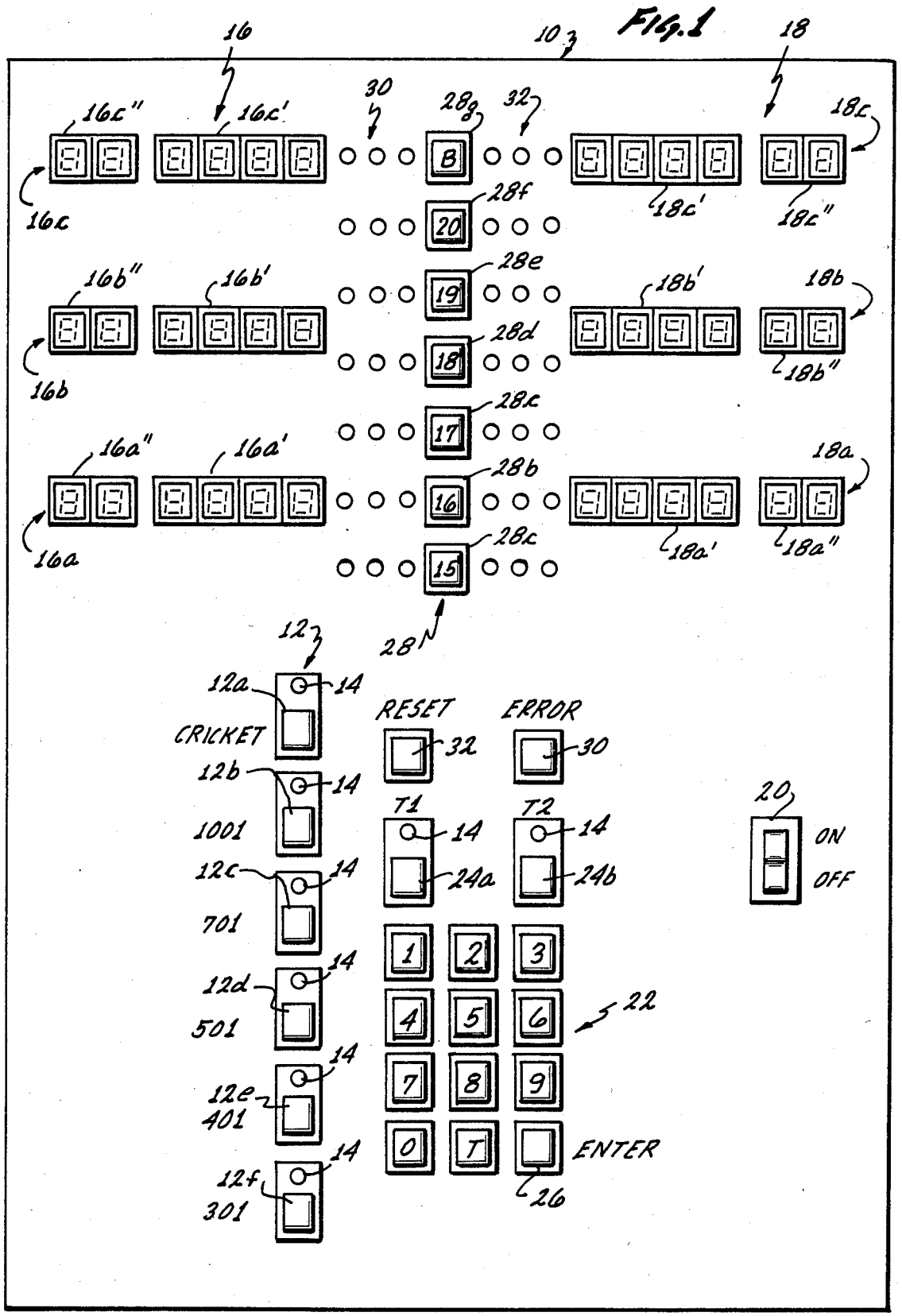
FIG. 1 shows a typical data entry switch and numerical display layout for the improved scorekeeper of this invention.

The electronic dart scoring device of this invention in a presently preferred embodiment shown in FIG. 1, comprises a front panel 10 on which are arranged a first group 12 of game selecting switches **12*a* through 12*f*. Each switch is connected to a digital circuit such that by actuation of the switch a particular dart game is selected. In the illustrated embodiment the games provided include cricket, 1001, 701, 501, 401, and 301. It will be understood that this selection of games merely represents the more popular games and is not exclusive of other dart games. Each game select switch may have an associated light emitting diode 14 which is connected to the digital circuits such that it remains lit once a game selection has been made to serve as a continual reminder to the players. The front panel further includes two arrays 16 and 18 of numerical displays which may advantageously consist of relatively large seven segment L.E.D. readouts. The numerical readouts in each set are disposed in three horizontal rows arranged vertically one over the other. Each row is broken up into a four digit game score display and a two digit individual score display. Each array of displays 16 and 18 may include three rows of digital displays connected to the digital circuitry such that the latest or current game scores are displayed on the bottom rows, 16***a* and 18*a* respectively of each array, the last intermediate scores are displayed on rows 16*b* and 18*b*, and the prior to the last intermediate game scores are shown on rows 16*c* and 18*c*, respectively.

The system is switched on by means of a power switch 20 connected for supplying electrical power to the various system circuits and displays. A game is then selected by pressing one of the game select switches 12. For example, by pressing switch 12*e*, the game of 401 is selected. The player or team is then selected by pressing one of the two team select switches 24*a* corresponding to team 1, or 24*b* associated with team 2. A first round of darts is thrown by, e.g., player 1 and the resulting total score of the thrown darts is entered into the scorekeeper by pressing the appropriate digits on keyboard 22. At this point the beginning score of 401 will be displayed on the four digit display group 16*a*′ of row 16*a* while the first individual score representing the total of the first throw of darts will be shown on the two digit group 16*a*″ of the same line. The individual score is then entered by pressing the "Enter" switch 26 grouped with the entry keyboard 22. This causes the scorekeeper computer circuits to subtract the individual score from the beginning score on line 16*a*, move the beginning score up to line 16*b*, and display the new current score on line 16*a*. A throw of three darts is then made by the second team or player, and this new individual score is entered by first pressing switch 24*b* to instruct the scorekeeper device that the entries are to be directed to the second array of displays 18, and then entering the three dart throw score by means of the keyboard 22. The beginning score for team two is likewise first displayed on the four digit group 18*a*′ of line 18*a* at the time that the game selection is made. The first individual score entered, representing the first throw of darts by the second team or player, is shown in the two digit dislay 18*a*″ of the bottom line 18*a*. Upon pressing the enter switch 26, the individual score of line 18*a* is subtracted from the beginning score, the beginning score is moved up to the four digit display 18*b*′ of line 18*b* and the new current game score for the second team is shown on the four digit 18*a*′ display of the bottom line 18*a*. It is then the first team's turn to throw and the new individual score representing the total of the second throw of darts is entered by means of the keyboard 22. This causes the first individual score of the first throw of darts for the first team to move up to the two digit display 16*b*″ of the second line 16*b*, and the new individual score representing the second throw of darts of the first team to be shown in the two digit display 16*a*″ of the bottom line 16*a*. Upon then pressing the switch 26, the new individual score is entered by subtracting the same from the current score shown on the bottom line 16*a*. The new game total for the first team is thus shown at 16*a*′ on the bottom line 16*a*, the last previous score is then moved up to the four digit display 16*b*′ of line 16*b* and the beginning game score is now displayed on the four digit group 16*c*′ of the top line 16*c*. The same process is repeated for the second team or player by pressing the team select switch 24*b*, entering a new individual score and pressing the enter switch 26. The process continues in a cyclic fashion, the individual scores and game scores moving up step by step on the successive lines of numerical displays 16 and 18. As the game progresses, the arrays show a scrolling series of successive individual scores and resulting game scores including the current game score and two immediately previous intermediate game scores. It is understood that the arrays are not limited to three rows each, but may include any number of rows.

When a player lands a dart on one of these numbers, the score is entered by pressing the corresponding dedicated switch in row 28 which includes switches 28*a* through 28*g*. The switches 28*a* through 28*f* correspond respectively to the numbers 15 through 20, while switch 28*g* is associated with the bullseye. Each switch in the row 28 has associated with it two sets of three L.E.D.s disposed in a horizontal row, three L.E.D.s on each side of each switch. One or the other group of three L.E.D.s is selected by the team select switches 24*a* and 24*b*. By pressing for example switch 24*a*, the L.E.D.s on the left side of the switch row 28 are selected.

An auxiliary group of switches 28 preferably disposed in a vertical row on the panel ten between the display arrays 16 and 18 includes switches 28*a*–28*g*, each of which is dedicated to a particular bed on the dartboard. Switches 28*a*–28*f* correspond to bed numbers 15 through 20 respectively, and switch 28*g* corresponds to the Bullseye.

The dedicated switches 28 are enabled only if the game of cricket has been selected by pressing switch 12*a*. To each side of each switch 28*a*–28*g* is a horizontal set of three lamps such as light emitting diodes (L.E.Ds) defining a first L.E.D. array 30 associated with team one, and a second L.E.D. array 32 associated with team two. The auxiliary L.E.D. arrays 30, 32 are selected by actuating the team select switches 24*a*, 24*b*. Thus, by pressing team select switch 24*a* the left group of L.E.D. indicators is selected and upon pressing one of the dedicated switches 28*a* through 28*g*, one of the L.E.D.s corresponding to the particular switch is lit. Upon subsequent scoring of the particular numbers by the same player at any point in the game, the dedicated switch corresponding to each number is pressed again to light a second, and then a third L.E.D. Once all three L.E.D.s for a particular dedicated switch 28*a*–28*g* for a given team are lit, subsequent dart landings in a bed corresponding to that switch are scored by entering the bed value by means of the keyboard 22 and thus adding that number to the numerical score on the numerical L.E.D. displays 16 or 18, in accordance with accepted cricket game rules.

An "Error" switch 30 is provided for canceling the last score entry made through the keyboard 22. If an error is made, the entry may be cancelled by pressing error switch 30. Once a game has been completed, the scorekeeping board and system memories may be cleared by pressing reset button 32, which zeroes all the numerical displays, extinguishes the auxiliary L.E.D. arrays 30 and 32, and also extinguishes L.E.D.s associated with the various information entry switches including the game select switches 12 and team select switches 24*a* and 24*b*.

Figure 2:
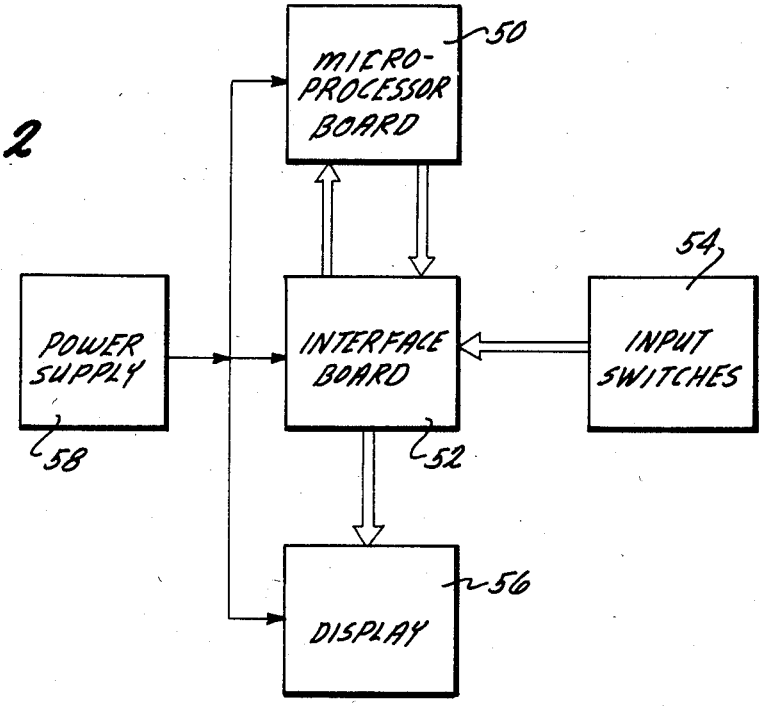
FIG. 2 is a block diagram of the electronic scorekeeper of this invention.

A better understanding of the system of this invention will be gained by reference to the block diagram of FIG. 2 wherein the system is seen to include a microprocessor board 50 connected for both output and input to an interface board 52. The interface board 52 in turn receives input from a number of input switches collectively designated 54 and which may include all of the input switches shown in FIG. 1 on the panel 10 of the electronic scorekeeper of this invention and including the game select switches 12, the numerical score entry keyboard switches 22, the team select switches 24*a* and 24*b*, the dedicated switches 28 for the cricket game as well as the error and reset switches 30, 32 respectively. The interface board interconnects the afore mentioned input switches to an input port of the microprocessor 50 which is programmed to interrogate the interface board so as to ascertain the status of individual input switches, and take appropriate action under program control in response to a closure of a normally open switch or opening of a normally closed switch in a manner indicated the presently preferred program illustrated in the flow chart of FIG. 4.

In response to the input information derived from the switches 54 through the interface board 52, the microprocessor board 50 under program control generates an output which is directed through the interface board 52 to an appropriate output device, e.g. visual displays generally numbered 56 and which may consist of the seven segment L.E.D. arrays 16 and 18 of FIG. 1 and the L.E.D. arrays 30, 32 associated with the dedicated cricket switches 28. Optionally, the game select switches may be provided with indicator L.E.D.s such as L.E.D.s 14 in the panel 10, so that when a particular game switch 12 is actuated, the microprocessor confirms the game selection by lighting the L.E.D. 14 associated with the particular game select switch. A power supply 58 is shown connected to each of the microprocessor board 50, interfaces board 52 and display 56 for supplying the required voltage and current to each of these subsystems.

The microprocessor board 50 will not be described in detail as a number of suitable microprocessor boards are presently available off the shelf from various manufacturers and distributors. These microprocessor boards include on board program memory into which is stored the algorithm a program such as represented by the flow chart of FIG. 4, and also include the necessary input/output ports through which the board is interconnected to the interface board 52. One example of a suitable readily available microprocessor board is the KIM I board which is a well documented board and which can be readily interfaced to input switches and output displays as shown in FIG. 2. The particular construction of the interface board 52 is not critical in terms of the exact components used, but by way of example may include a display driver such as the MM 74 C912 which is capable of driving the six 7 segment L.E.D.s of each horizontal display row 16*a, b, c* and 18*a, b* and *c*, in FIG. 1, for a total of six display drivers for the six horizontal rows. Suitable drivers are also provided for the auxiliary cricket game L.E.D.s in arrays 30 and 32. The various input switches are connected to the input ports of the board with appropriate debouncing resistor capacitor-networks.

FIG. 4 shows a flow chart diagram of a program for the microprocessor board 50 for implementing the dart game scorekeeping function of the present invention. All references to particular switches or displays are in connection with FIG. 1. It will be understood however, that the invention is not limited to the particular arrangement of panel 10. While the flow chart is essentially self-explanatory, a brief description may facilitate understanding of the same. Upon starting the system at step 100, the microprocessor turns off all indicator and display lamps at step 102 to clear the panel. The microprocessor board then repeatedly interrogates the game select switches 12 and upon finding that one of them has been actuated at step 103, the micropressor jumps or branches to the selected game at steps 103*a*–103*f*. The L.E.D. 14 in FIG. 1 associated with the actuated game select switch 12 may be lit by the microprocessor to confirm selection of the game at step 104*a*–104*f*. The appropriate beginning score is then displayed at the bottom row of seven segments L.E.D.s in the display arrays 16 and 18 at step 105*a–f*. Thus, for the various games between 301 and 1,001 the corresponding number will appear on the four digit groupings 16*a'*, 18*a'* of seven segment L.E.D.s in the bottom display rows 16*a* and 18*a*. If the game of Cricket has been selected, then the beginning score on all numerical displays in arrays 16 and 18 is zero.

Next, the microprocessor repeatedly interrogates the team select switches 24*a* and 24*b* and the reset switch 32 at steps 106*a*, 106*b* and 107*c* until one of them is actuated and activates the corresponding L.E.D. 14 at steps 107*a*, 107*b*, respectively if such is provided, to confirm the selection of one or the other team. At this point, the microprocessor 50 is ready to accept input from the numerical score entry keyboard 22 indicative of the individual points scored during a throw of e.g. three darts by a particular player, the microprocessor thus enters into a waiting state during which it repeatedly interrogates the switches of keyboard 22. When an individual throw score total is entered it is then displayed by the microprocessor during step 108 in the program on the two-digit 16*a''* or 18*a''* grouping of the bottom display row 16*a* or 18*a*, depending on which team has been selected. After the individual score is keyed in on the keyboard 22, and displayed at step 108 of the program, the error switch 30 is interrogated at step 109. If error switch is actuated, the individual score just keyed in is disregarded and a new corrected individual score is accepted at keyboard 22 and replaces the previous individual score on displays 16*a''* or 18*a''*. If the enter switch 26 is actuated while the error switch 30 is off, the microprocessor proceeds from step 110 to step 112 where the entered individual score is subtracted from the existing team score. The resulting new team score is then displayed as step 114 on row 16*a'* or 18*a'* of the panel, while the beginning score or previous team score is moved to displays 16*b'* or 18*b'* respectively.

If the game selected at step 103 was cricket, afterstep 105*f* the program proceeds along a separate branch indicated by the primed numbers in FIG. 4. The individual score, i.e. the thrower's points are displayed on displays 16*a''* or 18*a''* or on the auxiliary displays 30, 32 at step 108. In the case of the Cricket game, following steps 107*a'* or 107*b'* the microprocessor 50 repeatedly interrogates the dedicated switches 28 at the same time as the keyboard switches 22. If one of the switches 28*a* through 28*g* has been actuated, as opposed to one of switches on keyboard 22 one of the corresponding L.E.D.s in array 30 for team one or array 32 for team two are lit as part of the display of the new score at step 111. The microprocessor then interrogates the error switch 30 and the enter switch 26, at stepss 109' and 110' respectively. If the error switch is pressed the last score entry is disregarded and a new entry is accepted at the keyboard 22. If the enter switch is pressed before the error switch, the score entry is entered, and if it is a numerical score it is added to the team score as step 113 and displayed at the lowest row 16*a* or 18*a* on the panel as step 114'. The previous team score is then moved up to the next display row 16*b* or 18*b* and the new current team score is displayed on the bottom row 16*a* or 18*a*. The program then loops back indicated at points A, B, and C following display of the new game scores at step 114 or 114'. In the case of the 301 through 1,001 games, the loop is from step 114 back to step 106*a* where the team select switches are interrogated. In the case of the cricket game the program loop is likewise from step 112' to the team select interrogation step 106*a'* as shown in FIG. 4. Following interrogation of the team select switches 24*a*, 24*b* if it is found that neither team has been selected, the program branches to interrogate the reset switch. If it is found that the reset switch has been actuated, the program loops to the start block 100 and all of the lamps and displays are cleared to begin a new game at block 102. If the restart switch has not been actuated the program repeatedly interrogates the team select switches until either team select switch or the restart switch are actuated to enable the microprocessor to proceed with execution of the program.

In a presently preferred embodiment of the invention illustrated in block diagram form in FIG. 2, the scorekeeping device is provided with a voice recognition system 60 connected through the interface board 52 to an input port of the microprocessor board 50. The voice recognition system 60 is constructed to receive sounds and through a microphone or equivalent acoustic transducer and compare the acoustic information received with information stored in permanent memory in the voice recognition device 60 or the microprocessor board 50 representative of the sounds corresponding to a vocabulary of key words necessary for voice operation of the scorekeeping device. Upon recognizing such key words, the voice recognition system 60 delivers an input to the microprocessor board through the interface board which input is equivalent to manual actuation of one of the input switches 54. The number of words that need to be recognized by the system is limited and thus does not require an extensive memory capacity for the stored vocabulary information. These stored words may include the names of the games associated with each of the games select switches 12, the words "team one" and "team two" for providing the team select inputs the words "reset" and "error" corresponding to the respective switches 32 and 30 on the panel layout in FIG. 1, and a numeric vocabulary sufficient for recognition of the various input numbers representative of individual throw scores for providing input to the microprocessor 50 equivalent to actuation of the numerical keyboard 22 and the dedicated cricket switches 28. Various voice recognition systems are now commercially available and have a sufficient vocabulary for use with the present invention. While many of the presently available voice recognition systems need to be "trained" to recognize the sounds spoken by a particular individual and will not readily recognize the same words spoken by someone else, to an increasing extent newer systems being developed are more flexible in the range of voices to which the device will respond. For example, there are a number of voice recognitions systems that have of late become commercially available for use with personal computer systems. Such a voice recognition systems are capable of responding to a limited vocabulary carefully enunciated by a speaker without preliminary training of the system to the particular speakers voice. In addition, a voice actuated typewriter system is in an advanced stage of development by the International Business Machine (IBM) Company which is said to recognize a large vocabulary of spoken English without need for preliminary training. The voice recognition system of such a typewriter is well suited for incorporation into the present invention.

Figure 3:
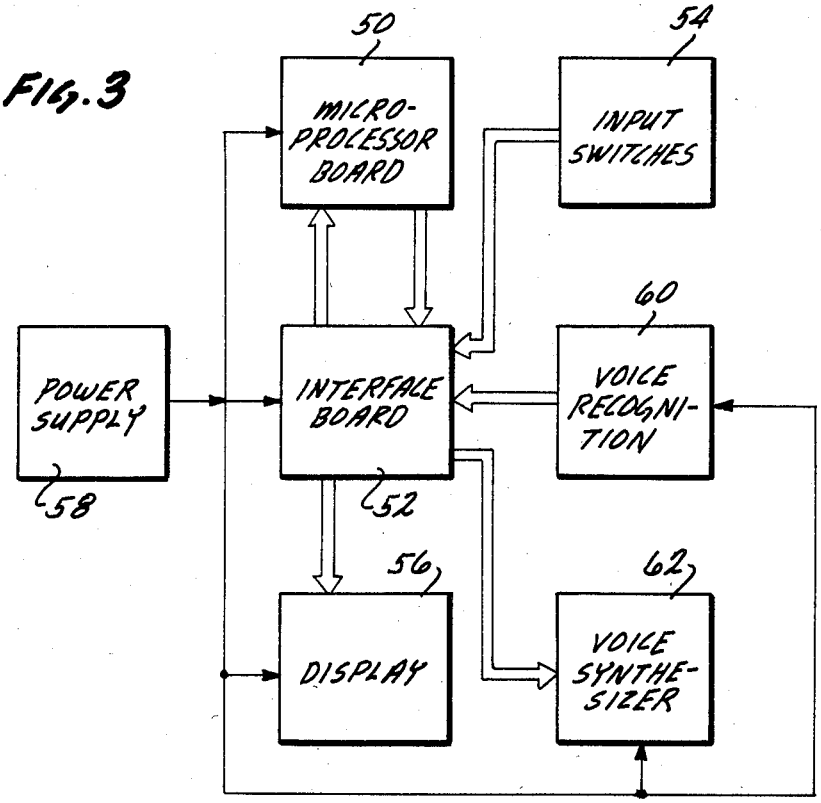
FIG. 3 is a block diagram of the electronic scorekeeper of this invention which has been provided with a voice recognition input system and a voice synthesized output system.

The voice actuated electronic scorekeeping system of FIG. 3 also includes a voice synthesized output system 62 which is connected to an output port of the microprocessor board 50 through the interface board 52. The system is desirably provided with output selection switching means which allow game participants to select either a voice synthesized output, a numerical readout output through the displays on panel 10, or simultaneous output through both the voice synthesizer and the panel displays. The panel displays have the advantage of continuity of output, in that score information may be read at a glance by the game participants, while the voice output is stated once for each score update by the microprocessor 50. Continuous repetition of the score by the voice synthesizer would be too annoying and would distract the players. It is contimplated, therefore, that the electronic scorekeeper of this invention be provided with both visual and and audible output systems. The voice output overcomes certain limitations of the panel readouts which have been discussed earlier in this specification, but preferably does not replace the panel readouts.

To avoid interference between the voice output and voice inputs systems, the voice recognition system 60 is disabled during output by the voice synthesizer 62.

In the embodiment illustrated in FIG. 3, the voice synthesizer system 62 includes suitable audio amplifier means and acoustic driver such as a loudspeaker for delivering the voice output at a sufficient volume and low distortion to be clearly heard by all game participants and spectators. In a further embodiment of the invention, the voice synthesizer output signal is connected for modulating a low power radio frequency signal. The radio frequency carrier modulated with the score information is received by lightweight, portable miniaturized radio receives tuned to the transmitter frequency and worn by each of the game participants and any interested spectators. The personal receivers derive an audio output from the modulated signal for driving lightweight headphones for earphones worn by the players and spectators to assure clear communication of the score output information unimpedance by noise in the environment. A system such as this is highly desirable in crowded, lively pubs and similar locations where great numbers of individuals engage in socializing, drinking and other activities unrelated to the game of darts, but in immediate proximity to the dart players. The system is desirably provided with switch means for selecting the radio channel exclusively or in conjunction with one or both of the previously described output modes namely the panel displays or general audio output through a loudspeaker system.

To increase the reliability of the voice recognition input system 60, the voice recognition system is normally nonresponsive to the various preprogrammed key words and is only responsive to a password which is preprogrammed in the system. Recognition of the password by the system 60 opens a window in time, that is a period of time during which the system 60 becomes responsive to the key words. In this manner, the scorekeeping device is not erroneously activated and confused by keyword spoken unintensionally during normal conversation between players or bystanders. This period of time during which the voice recognition system 60 becomes fully operative may be relatively brief, such as five seconds since typically only one or two words need to be spoken as the voice input.

The voice synthesizer output system 62 can be readily constructed by a person skilled in the art based on any one of several commercially available voice synthesis systems electronic voice synthesis boards are available from many suppliers and can be programmed to generate any desired vocabulary, limited only by the memory capacity of the particular system. The interfacing of such a voice synthesizer system to the microprocessor board through an interface 52 will be apparent to those skilled in the art and is readily achievable using known design techniques.

It must be understood that many alterations and modifications may be made by those having ordinary skill in the art to the embodiment of the invention disclosed herein without departing from the spirit and scope of the invention. Therefore, the presently illustrated embodiment has been shown only by way of example and for the purposes of clarity and should not be taken to limit the scope of the following claims.

A sample dialog between a voice synthesis ouput unit of the present invention and a player may proceed as follows. After the main power switch to the scorekeeping device has been actuated, the "on" indicator light lights up, indicating that the unit is operational. A volume control, if one is provided with the voice synthesis output unit, may be adjusted to a proper level at this time.

Player - "unit ready"?
Unit - "Please align vertically all of the quoted dialog 'ready'"
Player - "Display team 'A' - team 'B'"
Unit - "'A' - 'B' ready"
Player - "Game 301"
Unit - "Ready"
Player - "Team 'A' 60 points"
Unit - "60 on 'A'"
etc.

The above is a typical exchange between a player or scorekeeping referee and the electronic scorekeeping unit of this invention. The human speaker interacts with the device through the voice recognition system 60 in FIG. 3 and the electronic scorekeeping device responds through the voice synthesizer unit 62. The voice exchange, in substance, is equivalent to the actuation of panel switches by the player and the responsive turning on of indicator lights or numerical displays by the scorekeeping device. It will be appreciated that a rather limited vocabulary will suffice both on the part of the player and the scorekeeping device to sustain the necessary voice exchange, thus keeping the cost and complexity of the voice recognition and voice synthesizer units to a minimum.

We claim:

1. An electronic dart game scorer comprising in combination:

first and second numerical score display means;

a plurality of game select switches including a cricket game select switch;

computer means responsive to actuation of any one of said game select switches for displaying a particular beginning score associated with each of said switches on both said first and second display means; and team select means for selecting one of said first and second display means for score updating; and score entry means connected to said computer means for updating said beginning score to derive successive intermediate game scores on said selected display means;

auxiliary input means connected to said computer means and associated with said cricket game select switch, said auxiliary input means being actuatable for registering dart landings in particular beds of a dartboard;

auxiliary display means associated with said auxiliary input means for displaying each such registered dart landing apart from said numerical score display means.

said updating consisting of either addition or subtraction of individual numerical throw score entries made through said score entry means, actuation of a particular game select switch being operative for presetting said computer means to perform either said addition or subtraction of all throw score entries made subsequent to actuation of the particular game select switch.

2. The electronic dart game scorer of claim 1 wherein said auxiliary input means includes a plurality of switches each switch being dedicated to a particular bed of a dart board, and said auxiliary display means include a plurality of lamps representative of each team associated with each switch and interconnected to said computer means such that one said lamp is illuminated each time the corresponding switch is actuated, said lamp being selected in cooperation with said team select means.

3. The electronic dart game scorer of claim 2 wherein said auxiliary display means include two sets of three lamps associated with each said dedicated switch, each set of three lamps being selectable by actuation of said team select means.

4. An electronic dart game scorer comprising in combination:

game score output means;

game select means including cricket game select means;

team select means;

computer means responsive to said game select means for displaying a beginning score on said display means;

score entry means connected to said computer for updating said beginning score to derive successive intermediate game scores;

normally inoperative auxiliary input means connected to said computer means said auxiliary input means being enabled only responsive to activation of said cricket game select means for registering dart landings in particular beds of a dartboard; and auxiliary display means associated with said auxiliary input means for displaying each such registered dart landing apart from said numerical display means;

said updating consisting of either addition or subtraction of individual numerical throw score entries made through said score entry means, actuation of a particular game select switch being operative for presetting said computer means to perform either said addition or subtraction of all throw score entries made subsequent to actuation of the particular game select switch.

5. The electronic dart game scorer of claim 4 wherein said game score output means comprise numerical display means;

said auxiliary input means include a plurality of switches, each switch being dedicated to a particular bed of a dart board; and said auxiliary display means include two sets of three lamps associated with each said dedicated switch, each set of three lamps being selectable by actuation of said team select means.

6. The electronic dart game scorer of claim 4 wherein said score entry means comprise speech recognition means for entering spoken score information into said computer means.

7. The electronic dart game scorer of claim 4 wherein said game score output means further comprise voice synthesizer means connected to said computer means for converting score information output of said computer to audible synthesized speech.

* * * * *